US010066848B1

(12) United States Patent
Lorenz et al.

(10) Patent No.: US 10,066,848 B1
(45) Date of Patent: Sep. 4, 2018

(54) ILLUMINATING SUBSTRATE-MOUNTABLE DEVICES

(71) Applicant: Emerson Electric Co., St. Louis, MO (US)

(72) Inventors: Thomas B. Lorenz, St. Louis, MO (US); William D. Rhodes, Red Bud, IL (US); Alan Cobourn, St. Charles, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 15/614,847

(22) Filed: Jun. 6, 2017

(51) Int. Cl.

| | |
|---|---|
| ***F21V 23/00*** | (2015.01) |
| ***F24F 11/30*** | (2018.01) |
| ***G05D 23/19*** | (2006.01) |
| *F21V 23/04* | (2006.01) |
| *F21Y 115/10* | (2016.01) |
| *F24F 11/56* | (2018.01) |
| *F24F 11/89* | (2018.01) |
| *F24F 11/52* | (2018.01) |
| *F24F 110/10* | (2018.01) |

(52) U.S. Cl.
CPC ..... *F24F 11/30* (2018.01); *F21V 23/004* (2013.01); *F21V 23/007* (2013.01); *G05D 23/19* (2013.01); *F21V 23/002* (2013.01); *F21V 23/0442* (2013.01); *F21Y 2115/10* (2016.08); *F24F 11/52* (2018.01); *F24F 11/56* (2018.01); *F24F 11/89* (2018.01); *F24F 2110/10* (2018.01)

(58) Field of Classification Search
CPC ..... F24F 11/89
See application file for complete search history.

(56) References Cited

U.S. PATENT DOCUMENTS

| | | | | |
|---|---|---|---|---|
| 2,612,597 | A | 9/1952 | Sherrard | |
| 3,009,051 | A | 11/1961 | Bittrolff | |
| 4,617,613 | A | 10/1986 | Rice | |
| 4,895,455 | A * | 1/1990 | Horning | G01D 11/28 116/304 |
| 5,113,318 | A | 5/1992 | Conley | |
| 5,491,615 | A * | 2/1996 | Nichols | F21V 21/14 362/147 |
| 6,207,899 | B1 | 3/2001 | Gillespie | |
| 6,402,333 | B2 * | 6/2002 | Gilmer | F21L 4/00 362/186 |
| 7,667,163 | B2 | 2/2010 | Ashworth et al. | |
| 7,726,581 | B2 * | 6/2010 | Naujok | G05D 23/1902 236/1 C |
| 8,630,742 | B1 * | 1/2014 | Stefanski | H05B 1/028 700/278 |
| 8,752,771 | B2 * | 6/2014 | Warren | F24F 11/0012 236/1 C |

(Continued)

*Primary Examiner* — Xanthia C Cunningham
(74) *Attorney, Agent, or Firm* — Harness, Dickey & Pierce, P.L.C.; Anthony G. Fussner

(57) ABSTRACT

Disclosed are exemplary embodiments of sub-base assemblies for substrate-mountable devices and related methods. In an exemplary embodiment, a sub-base assembly includes a cover, a base, and a circuit board having a plurality of wire terminals for receiving wiring passed through the base and circuit board. At least one light source is mounted on the circuit board and is operable, before the wiring is connected to the wire terminals, to direct light toward the wire terminals through the base.

16 Claims, 6 Drawing Sheets

(56) References Cited

U.S. PATENT DOCUMENTS

| | | | | |
|---|---|---|---|---|
| 8,802,981 | B2 * | 8/2014 | Wallaert | F24F 11/00 174/58 |
| 9,587,848 | B2 | 3/2017 | Adamik et al. | |
| 2008/0143275 | A1 * | 6/2008 | Hoffman | F21L 4/027 315/309 |
| 2010/0106306 | A1 * | 4/2010 | Simon | F24F 11/62 700/276 |
| 2013/0099009 | A1 * | 4/2013 | Filson | G05D 23/1902 236/1 C |
| 2013/0103204 | A1 * | 4/2013 | Stefanski | G05D 23/1902 700/276 |
| 2014/0199909 | A1 * | 7/2014 | Yamaguchi | C09D 183/04 442/233 |
| 2014/0226286 | A1 * | 8/2014 | Novotny | G05D 23/1902 361/747 |
| 2015/0096876 | A1 * | 4/2015 | Mittleman | H01H 11/00 200/341 |
| 2015/0220109 | A1 * | 8/2015 | von Badinski | G01P 15/00 340/539.12 |
| 2015/0316285 | A1 * | 11/2015 | Clifton | F24D 19/10 236/1 C |
| 2016/0327301 | A1 * | 11/2016 | Ribbich | F24F 11/30 |
| 2016/0334812 | A1 * | 11/2016 | Zikes | G05D 23/1905 |
| 2016/0363342 | A1 * | 12/2016 | Gutch | F24F 11/0086 |
| 2016/0377797 | A1 * | 12/2016 | Sundaram | G02B 6/0068 345/102 |
| 2017/0130981 | A1 * | 5/2017 | Willette | F24F 3/16 |

* cited by examiner

ILLUMINATING SUBSTRATE-MOUNTABLE DEVICES

FIELD

The present disclosure generally relates to illuminating substrate-mountable devices, including but not limited to wall-mountable thermostats and other climate control system devices mountable on substrates.

BACKGROUND

This section provides background information related to the present disclosure which is not necessarily prior art.

Thermostats are typically installed on walls in residences and offices to control heating and/or cooling systems. Wires for control of the heating and/or cooling systems are typically passed through a wall opening so that a thermostat may be connected to the wires and mounted over the wall opening.

DRAWINGS

The drawings described herein are for illustrative purposes only of selected embodiments and not all possible implementations, and are not intended to limit the scope of the present disclosure.

Corresponding reference numerals indicate corresponding (although not necessarily identical) parts throughout the several views of the drawings.

DETAILED DESCRIPTION

Example embodiments will now be described more fully with reference to the accompanying drawings.

The inventor hereof has recognized that many thermostats are installed in hallways or in areas that are poorly lit. Where there is a lack of lighting, a user may have to hold a flashlight while wiring and installing a thermostat or other substrate-mountable device. Accordingly, the inventors have developed and disclose herein exemplary embodiments of sub-base assemblies for substrate-mountable devices and related methods. One example sub-base assembly includes a cover, a base, and a circuit board having a plurality of wire terminals for receiving wiring passed through the base and circuit board. At least one light source is mounted on the circuit board and is operable, before the wiring is connected to the wire terminals, to direct light toward the wire terminals through the base. It should be noted generally that although various embodiments are described herein with reference to thermostats, embodiments also are contemplated in relation to other wall-mountable and substrate-mountable devices, including but not limited to other climate control system controllers, other types of controllers, monitors, etc.

Figure 1:
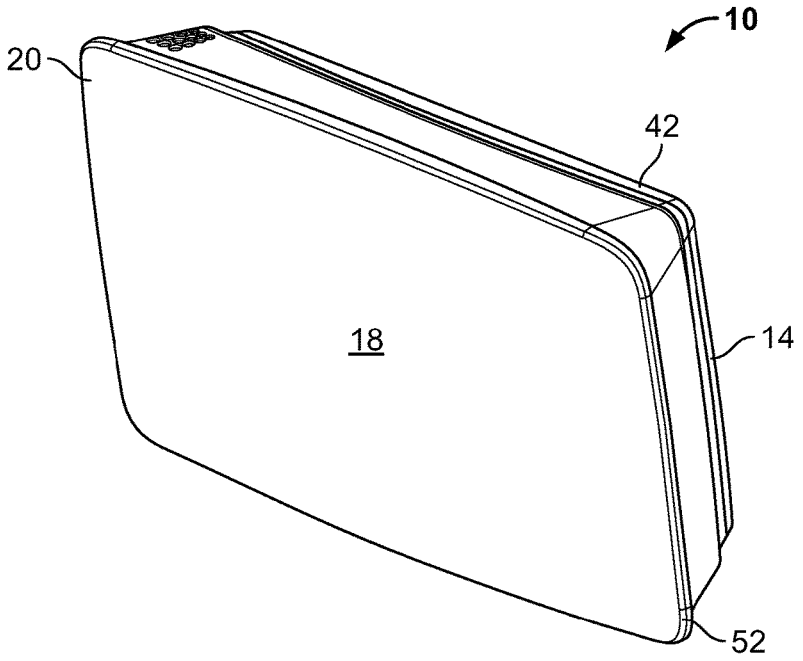
FIG. 1 is a perspective view of a thermostat in accordance with one example embodiment.
Figure 2:
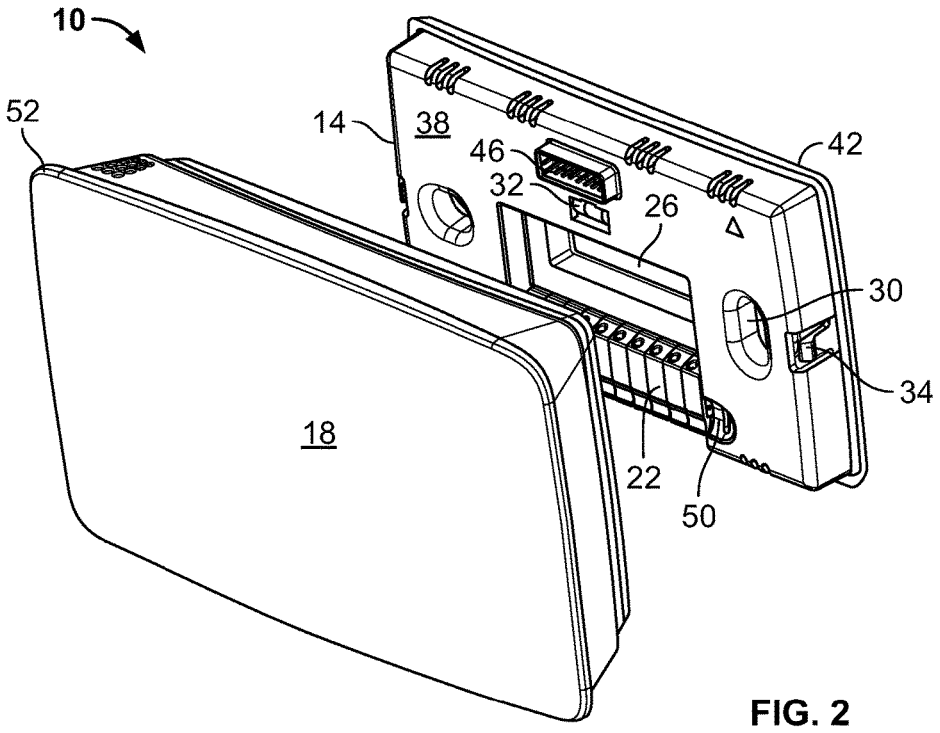
FIG. 2 is an exploded perspective view of a thermostat in accordance with one example embodiment.
Figure 3:
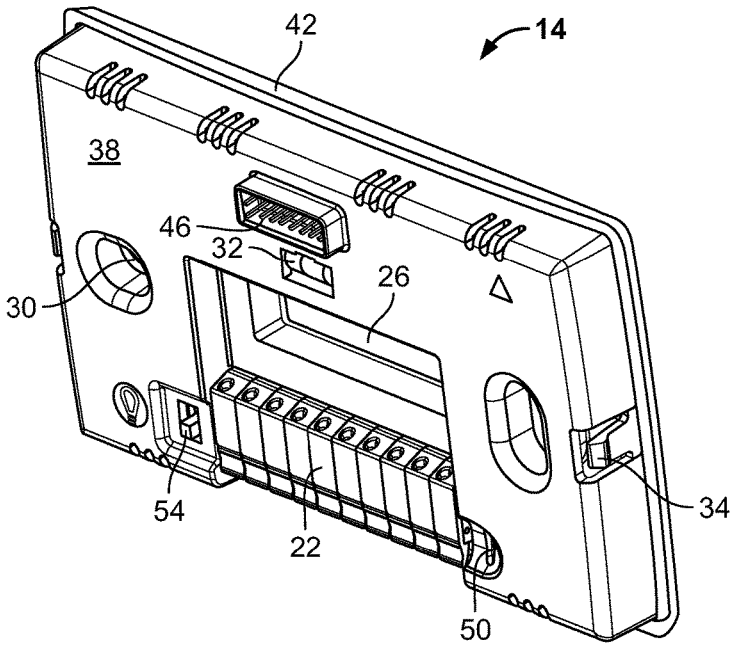
FIG. 3 is a perspective view of a thermostat sub-base assembly in accordance with one example embodiment.
Figure 4:
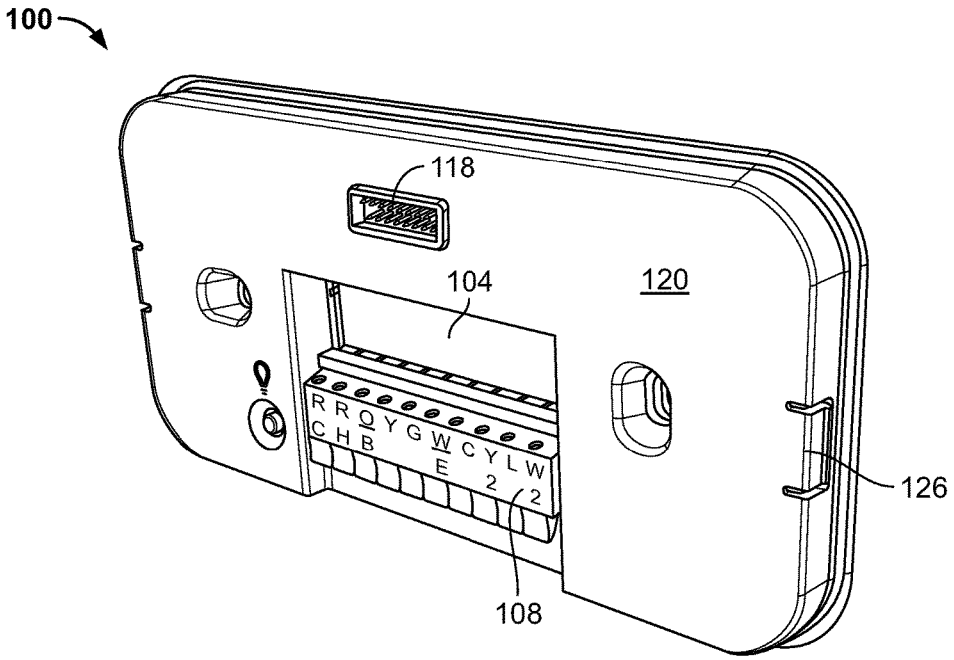
FIG. 4 is a perspective view of a thermostat sub-base assembly in accordance with one example embodiment.

With reference now to the figures, FIGS. 1-3 illustrate an exemplary embodiment of a thermostat 10 embodying one or more aspects of the present disclosure. The wall-mountable thermostat 10 includes a sub-base assembly 14 to which an outer thermostat assembly 18 is connected, e.g., as shown in FIG. 1. The example outer thermostat assembly 18 includes a front lens 20 made of translucent and/or transparent material. The example lens 20 extends across the outer thermostat assembly 18 and has a translucent rim 52 projecting beyond the rest of the outer thermostat assembly 18. In various embodiments, however, an outer thermostat assembly may include features other than or in addition to a translucent lens and/or projecting rim.

As shown in FIGS. 2 and 3, the sub-base assembly 14 includes a plurality of wire terminals 22 and has a wiring passage 26 through which climate control system wiring may be passed, e.g., from a wall opening for connection to appropriate wire terminals 22 when the thermostat 10 is being installed over the wall opening. Screw holes 30 are provided through the sub-base assembly 14, e.g., for attaching the sub-base assembly 14 to a wall. A bubble level 32 is provided as an aid to installing the sub-base assembly 14 in a level orientation. The outer thermostat assembly 18 is connectible to the sub-base assembly 14, e.g., via depressible clips 34 on a cover 38 of the sub-base assembly 14. Various connection types, however, could be provided in various embodiments for connecting an outer assembly of a substrate-mountable device to a sub-base assembly of the device, and for connecting the device to a substrate.

The sub-base assembly 14 includes a base 42 that is at least partially translucent or transparent. A circuit board (not shown in FIGS. 1-3) is provided on the base 42 beneath the cover 38. Electrical connectors 46 extend from the circuit board through the cover 38 for connection with a corresponding thermostat circuit connector (not shown) provided in the outer thermostat assembly 18. In the present example embodiment, a "jumper" disconnector 50 is provided by which to optionally clip a jumper (not shown) that otherwise would connect RC and RH wires. The jumper would be disconnected, e.g., dependent on the particular climate control system for which the thermostat 10 is to be used. As shown in FIG. 3, a toggle switch 54 or other type of manually operable switch is provided whereby an installer or other user may activate at least one light source (not shown in FIGS. 1-3) in the sub-base assembly 14 for illuminating the wire terminals 22, e.g., during wiring of the sub-base assembly 14.

Another example embodiment of a thermostat sub-base assembly is indicated generally in FIGS. 4-7 and 9-10 by reference number 100. The sub-base assembly 100 has a wiring passage 104 through which climate control system wiring may be inserted, e.g., so that an installer may connect the wiring to appropriate wire terminals 108 of the sub-base assembly 100. The sub-base assembly 100 includes a base 112 and a circuit board 116 provided on the base 112.

A cover 120 is provided over the circuit board 116 and connected with the base 112. Electrical connectors 118 extend from the circuit board 116 through the cover 120 for connection with thermostat circuits of an outer thermostat assembly (not shown). Screw holes 122 are provided through the sub-base assembly 100, e.g., for attaching the sub-base assembly 100 to a wall. The outer thermostat assembly is connectible to the sub-base assembly 100, e.g., via clips 126 on the cover 120.

Figure 9:
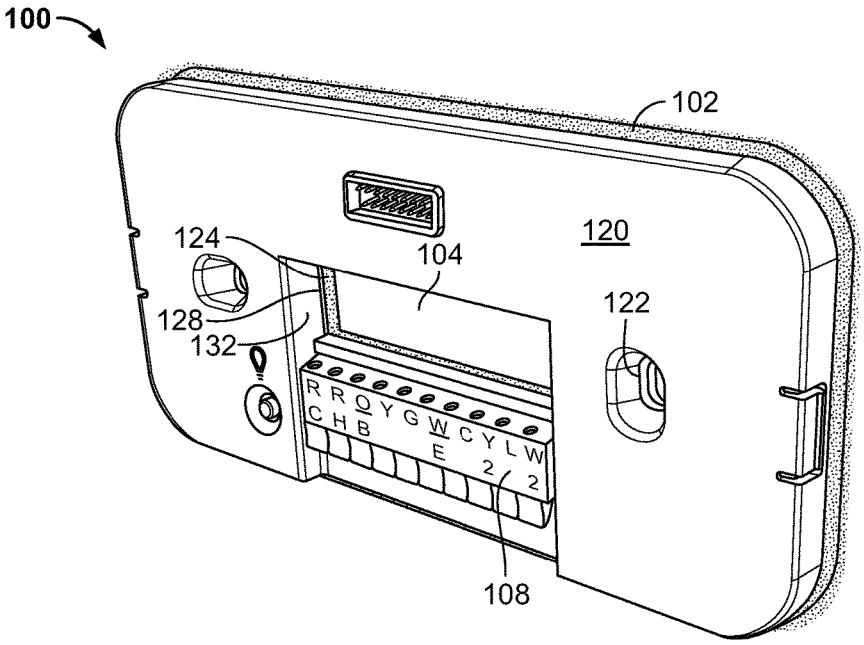
FIGS. 9 and 10 are front perspective views of a thermostat sub-base assembly illuminated in accordance with one example embodiment.
Figure 10:
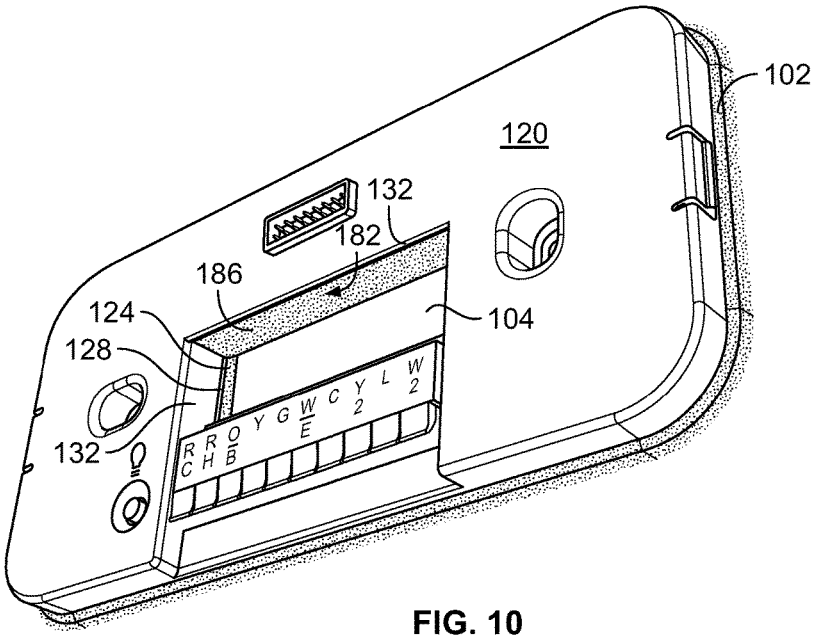

The example cover 120 may be opaque and may be made, e.g., of acrylonitrile butadiene styrene (ABS) plastic, although other or additional materials could be used. In the present example embodiment, the base 112 is made of translucent and/or transparent polycarbonate (PC) plastic, although other or additional materials could be used. As can be seen in FIGS. 9 and 10, the base 112, circuit board 116, and cover 120 have respective inner edges (124, 128, 132) that together define the wiring passage 104.

Figure 5:
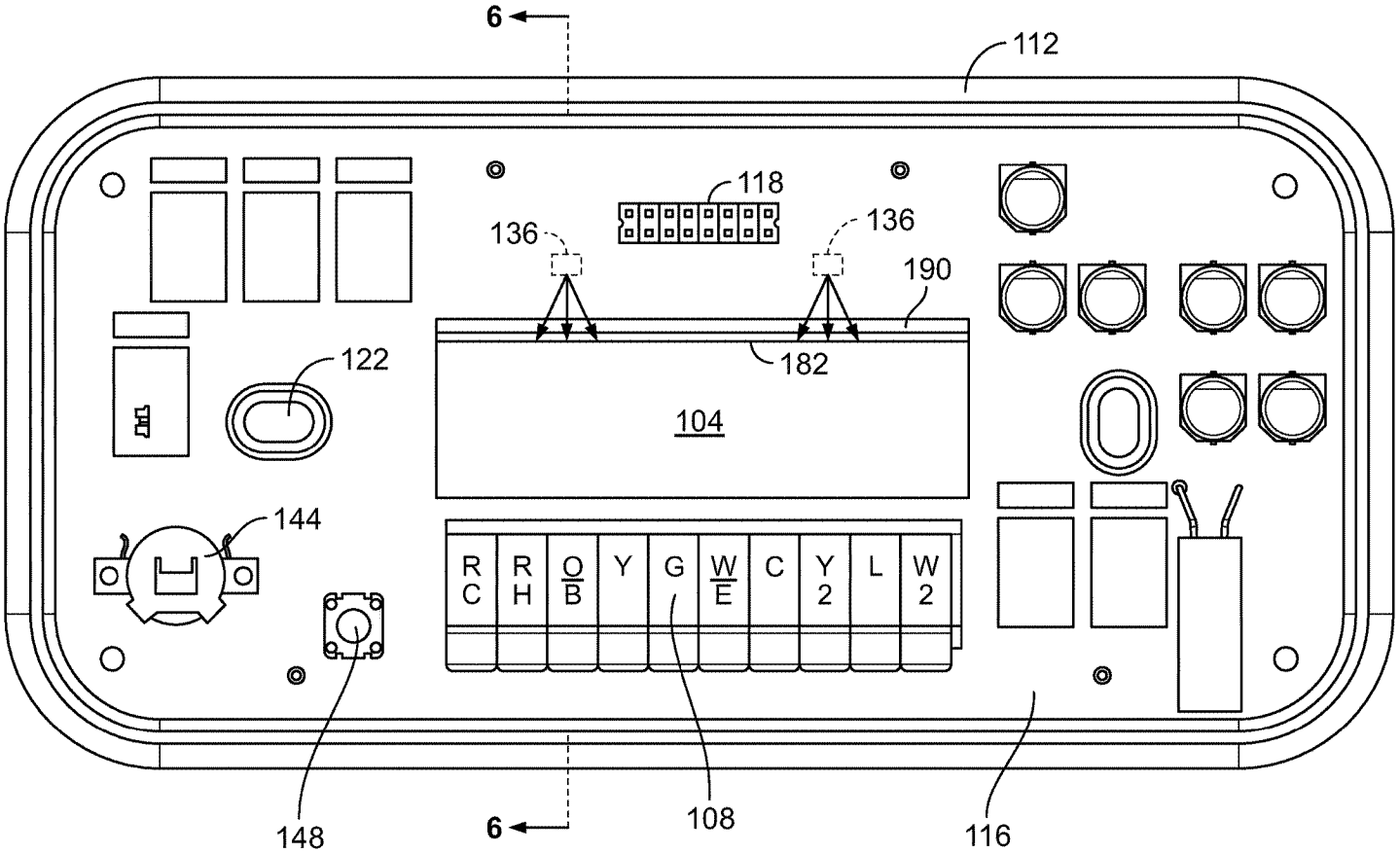
FIG. 5 is a frontal view of a thermostat sub-base assembly in accordance with one example embodiment, with a cover removed to show a circuit board of the assembly.
Figure 7:
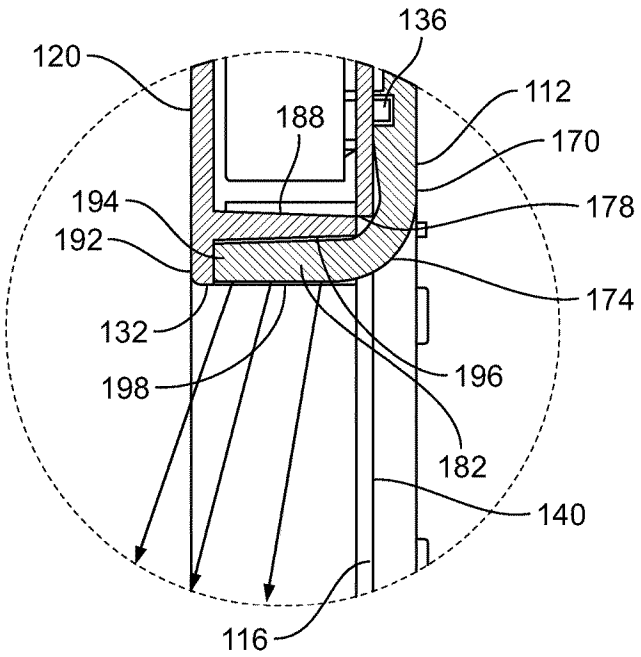
FIG. 7 is a partial side view of the example thermostat sub-base assembly of FIG. 6, the view being an enlargement of the area circled in FIG. 6.
Figure 6:
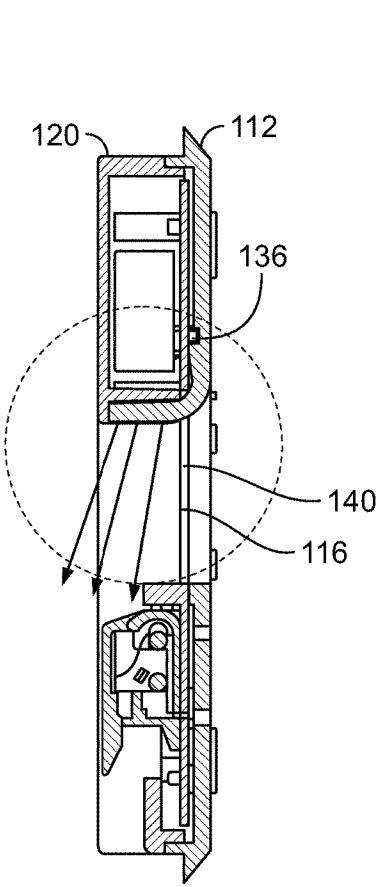
FIG. 6 is a side view of the example thermostat sub-base assembly of FIG. 5, the view taken along lines 6-6 with the cover in place over the circuit board.

FIG. 5 illustrates the sub-base assembly 100 with the cover 120 removed. As shown in FIGS. 5-7, the sub-base assembly 100 includes two right-angle light emitting diodes (LEDs) 136 surface-mounted to the circuit board back side 140 that faces the base 112. A battery 144, e.g., a coin cell battery, is provided to power the LEDs 136 during thermostat wiring and is operable, e.g., via a push button switch 148 or other switch. Additionally, in various embodiments and as further described below, two additional battery-operable right-angle light emitting diodes (LEDs) may be surface-mounted to the circuit board back side 140, e.g., lateral to and separated by the wiring passage 104. It should be noted generally that in various embodiments, other or additional types and/or numbers of LEDs and/or other light sources may be provided, at other or additional locations relative to a sub-base assembly circuit board and/or in other or additional configurations relative to a base.

As shown in FIGS. 5-7, a portion 170 of the base 112 adjacent the wiring passage 104 has an example curvature 174 extending past an upper portion 178 of the circuit board inner edge 128 and toward the cover 120 to provide an extension 182 of the base 112. As can be seen in FIG. 10, the cover inner edge 132 and extension 182 together define an upper surface 186 of the wiring passage 104. As shown in FIG. 7, a protrusion 188 of the cover 120 is positioned adjacent to the base extension 182 and extends, e.g., into or adjacent to a slot-like area 190 (more clearly shown in FIG. 5) defined by the circuit board inner edge upper portion 178 and curvature of the base extension 182. A lip 192 of the cover 120 forms the cover inner edge 132 and also abuts an end 194 of the base extension 182. In the present example embodiment, the cover protrusion 188 has a generally reflective, e.g., white, surface 196 adjacent the extension 182. A textured face 198 of the extension 182 is configured to scatter light rays passing through the face 198, as further described below.

Figure 8A:
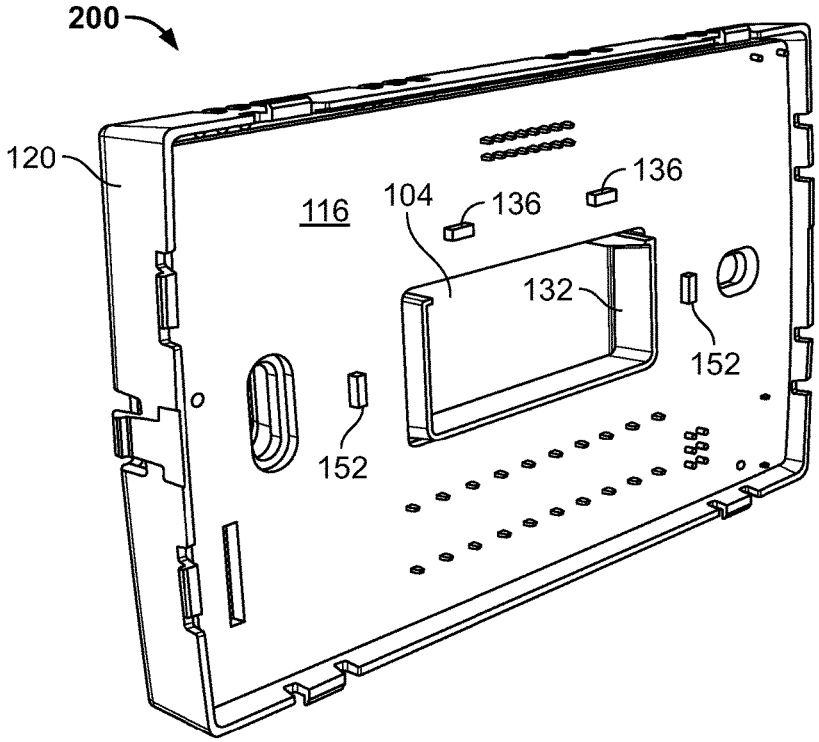
FIG. 8A is a rear perspective view of a circuit board of a thermostat sub-base assembly in accordance with one example embodiment, the circuit board being shown with a cover attached and with a base removed.
Figure 8B:
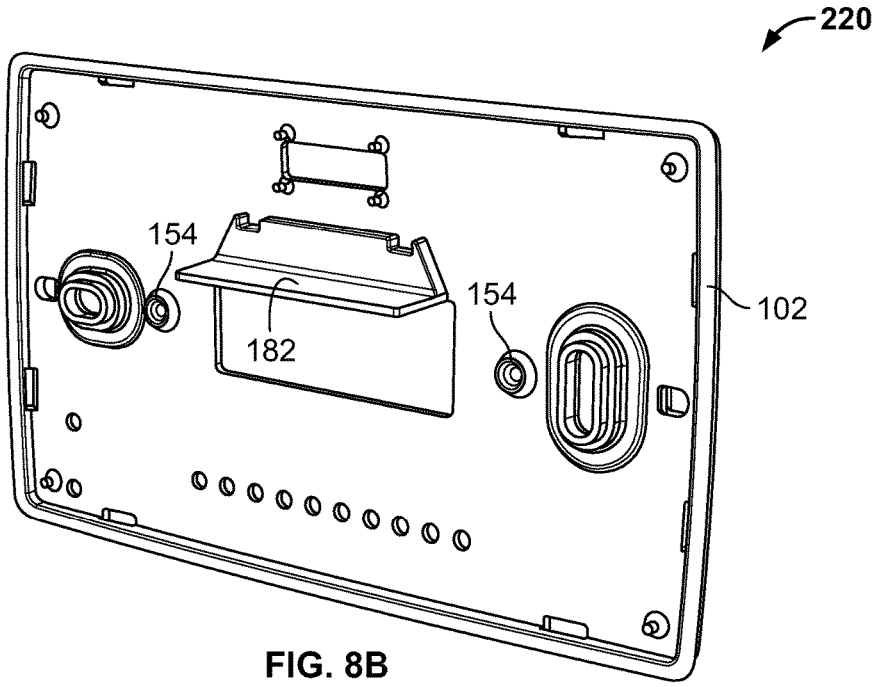
FIG. 8B is a front perspective view of a base of a thermostat sub-base assembly in accordance with one example embodiment.

FIG. 8A illustrates an example embodiment 200 of a thermostat sub-base assembly circuit board 116 and cover 120. Two laterally positioned LEDs 152, e.g., right-angle LEDs, are provided on the circuit board 116. A corresponding example embodiment of a base is indicated generally in FIG. 8B by reference number 220. The cover 120 of FIG. 8A may be "snapped" onto the base 220 to form a thermostat sub-base assembly that holds the circuit board 116 in proper orientation for use. The example base 220 is made of a translucent material and has a molded shape configured to perform, e.g., as a light pipe. For example, the base 220 is configured to direct light from LEDs 136 through the base extension 182 to provide wiring terminal area illumination. The base 220 also is configured to direct light from LEDs 152 through base structures 154, e.g., to illuminate the entire base 220, which has an outer edge 102 configured to extend beyond the cover 120.

When, for example, an installer of the sub-base assembly 100 activates the push button switch 148, light from the LEDs 136 is transmitted via the portion 170 and curvature 174 of the base 112 toward and through the textured face 198. Light is projected through and from the extension 182, e.g., as indicated by arrows in FIGS. 5-7. Light is reflected by the surface 196 of the cover 120 through the textured face 198 of the extension 182, which scatters light toward and over the wire terminals 108, e.g., as shown in FIGS. 9 and 10. Additionally or alternatively, in embodiments in which LEDs 152 can be battery-activated, e.g., via switch 148, the LEDs 152 can provide light to illuminate at least the outer edge 102 of the sub-base assembly 100, e.g., as shown in FIGS. 9 and 10, during wiring of the sub-base assembly 100.

In various embodiments, after installation of a thermostat assembly and sub-base assembly 100 has been completed, the switch 148 may be switched off. In various installed thermostat embodiments, at least the LEDs 152 are configured to receive operational power from a power stealing circuit of the thermostat. Thus a wall or other substrate on which a sub-base assembly is installed can be illuminated, e.g., so as to provide a glow around the thermostat after its installation has been completed. In thermostat embodiments in which a front lens 20 includes at least a translucent projecting rim 52, e.g., as previously discussed with reference to FIG. 1, light from the sub-base assembly outer edge 102 may be visible through the lens rim 52 of the installed thermostat.

In one example embodiment, an installed thermostat is configured to display one or more menu items on a touch screen or other device (not shown) for user selection. Menu item(s) may include, e.g., a "night light" option that is user-selectable to operate at least LEDs 152 through a power stealing circuit of the thermostat. In some embodiments, a thermostat may provide LED "ON" and/or "OFF" modes selectable by a user in relation to schedule(s) for time/temperature settings, e.g., for wake, leave, return and/or sleep periods. For example, a user may choose to have sub-base assembly LEDs "ON" for wake and sleep periods, and "OFF" for leave and return periods when the user considers ambient light to be sufficient. In some embodiments, a real-time clock may be used to program LED "ON" and "OFF" modes over time. Additionally or alternatively and in various embodiments, thermostat LED "ON" and/or "OFF" modes may be programmed remotely, e.g., through a software application on a user's mobile device, through a browser-based application, etc. In some embodiments, an outer thermostat assembly may include a switch whereby a user may manually actuate LED "ON" and/or "OFF" modes, e.g., to provide a night light.

In various embodiments, a climate control system controller may be provided that includes a sub-base assembly mountable on a substrate, and an outer assembly connectible to the sub-base assembly. The sub-base assembly has a cover, a base, and a circuit board having a plurality of wire terminals for receiving wiring passed from the substrate through the base and circuit board. The circuit board has a plurality of light sources mounted thereon and configured to provide light, through the base, onto the wire terminals, before the wiring is connected to the wire terminals. In some embodiments, the climate control system controller may be a wall-mountable thermostat.

Embodiments may also be provided of various methods relating to climate control system controllers and relating to providing illumination for controller sub-base assemblies and/or for sub-base assembly wire terminals, e.g., during wiring and/or upon completion of wiring of such controllers. One example method includes providing at least one light source on a circuit board for a thermostat sub-base assembly, and configuring a light path for light from the light source(s) through a transparent and/or translucent portion of a base for receiving the circuit board, to illuminate wire terminals of the sub-base assembly before the sub-base assembly receives power through the wire terminals. In various implementations, such a method further includes juxtaposing a generally reflective surface of a portion of a cover for the sub-base assembly with the portion of the base through which the light path is configured, whereby the cover is configured to reflect the light through the base portion onto the wire terminals.

Embodiments of the disclosure can facilitate the wiring and installation of a thermostat, by lighting the wiring area of a thermostat during installation. Providing such lighting can help the installer put the wiring in the proper locations and can speed up the installation process. Holding a separate flashlight and wiring a thermostat at the same time can be painful to an installer. In contrast, the foregoing embodiments can save time and can reduce or eliminate pain and inconvenience, thereby improving the installation experience. Additionally, after the thermostat has been installed, the light can be used, e.g., as a night light.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sub-base assembly for a climate control device, the sub-base assembly comprising:

a cover;

a base;

a circuit board having a plurality of wire terminals for receiving wiring passed through the base and circuit board; and at least one light source mounted on the circuit board and operable, before the wiring is connected to the wire terminals, to direct light toward the wire terminals through the base;

wherein:

at least a portion of the base is translucent and/or transparent; and the light is reflected through the at least a portion of the base from a surface of the cover over the circuit board.

2. The sub-base assembly of claim 1, wherein the cover has a passage to receive the wiring for connection with the wire terminals;

the at least one light source configured to provide light in the passage.

3. The sub-base assembly of claim 1, wherein the at least one light source comprises one or more light-emitting diodes (LEDs) mounted on the circuit board and configured to provide the light directed toward the wire terminals through the portion of the base.

4. The sub-base assembly of claim 1, comprising a plurality of light sources mounted on the circuit board, and a battery for powering the at least one light source;

the sub-base assembly further configured to provide power from a power stealing circuit of the climate control device to the plurality of light sources after the wiring is connected to the wire terminals.

5. The sub-base assembly of claim 1, wherein the base is configured as a light pipe to receive light from the at least one light source.

6. The sub-base assembly of claim 1, configured in the climate control device, wherein the at least one light source is operable in accordance with user input to the climate control device.

7. A climate control system controller comprising:

a sub-base assembly; and an outer assembly connectible to the sub-base assembly;

the sub-base assembly having a cover, a base, and a circuit board provided on the base and having a plurality of wire terminals for receiving wiring passed through the base and circuit board;

the circuit board having a plurality of light sources mounted thereon and configured to provide light, through the base, onto the wire terminals before the wiring is connected to the wire terminals;

wherein the cover of the sub-base assembly has a surface configured to reflect the light through a transparent or translucent portion of the base onto the wire terminals.

8. The climate control system controller of claim 7, wherein at least one of the light sources is a right-angle light emitting diode (LED) surface-mounted on the circuit board and adjacent the base.

9. The climate control system controller of claim 7, further comprising at least one right-angle light emitting diode (LED) configured to provide light through the base and around the installed climate control system controller.

10. The climate control system controller of claim 9, wherein the at least one right-angle light emitting diode (LED) is powered through a power stealing circuit of the climate control system controller.

11. The climate control system controller of claim 7, comprising a wall-mountable thermostat, wherein the at least one light source is operable in accordance with a user schedule input to the thermostat.

12. A method comprising:

providing at least one light source on a circuit board for a thermostat sub-base assembly;

configuring a light path for light from the at least one light source through a transparent and/or translucent portion of a base for receiving the circuit board, to illuminate wire terminals of the sub-base assembly before the sub-base assembly receives power through the wire terminals; and juxtaposing a generally reflective surface of a portion of a cover for the sub-base assembly with the portion of the base through which the light path is configured;

whereby the cover is configured to reflect the light through the base portion onto the wire terminals.

13. The method of claim 12, wherein providing the at least one light source comprises surface-mounting one or more right-angle light emitting diodes (LEDs) on the circuit board and adjacent the base.

14. The method of claim 12, wherein the circuit board includes a plurality of light sources, and at least a given one of the light sources is connectible with a power stealing circuit of a thermostat.

15. The method of claim 14, further comprising directing light from the at least a given one of the light sources throughout the base, the directing performed by a molded structure of the base.

16. The method of claim 15, performed to illuminate at least an outer edge of the sub-base assembly.

* * * * *